United States Patent [19]

Mayer et al.

[11] 3,945,321

[45] Mar. 23, 1976

[54] SHELL AND METHOD OF MANUFACTURING THE SAME

[75] Inventors: Cornelius Mayer, Fallanden; Günther Diewald; Heinrich Reber, both of Zurich, all of Switzerland

[73] Assignee: Werkzeugmaschinenfabrik Oerlikon-Bührle AG, Zurich, Switzerland

[22] Filed: Jan. 20, 1975

[21] Appl. No.: 542,433

[30] Foreign Application Priority Data

Feb. 13, 1974 Switzerland ..... 1985/74

[52] U.S. Cl. ..... 102/67; 86/20 B

[51] Int. Cl.[2] ..... F42B 13/48

[58] Field of Search ..... 102/64, 67; 86/20 B

[56] References Cited

UNITED STATES PATENTS

| | | | |
|---|---|---|---|
| 3,718,091 | 2/1973 | Theate | 102/67 |

FOREIGN PATENTS OR APPLICATIONS

| | | | |
|---|---|---|---|
| 305,639 | 6/1920 | Germany | 102/64 |
| 617,519 | 4/1961 | Canada | 102/64 |
| 668,011 | 12/1938 | Germany | 102/64 |

*Primary Examiner*—Verlin R. Pendegrass
*Attorney, Agent, or Firm*—Werner W. Kleeman

[57] ABSTRACT

A shell possessing a substantially cylindrical shell casing in which there is contained an explosive mass and at the inner wall of which casing there bears a layer of substantially spherical-shaped projectiles of the same size which are partially embedded in the explosive mass and between which there is locacted a filler mass. The projectiles which are partially embedded in the filler mass are exposed to axial pressure in the finished fabricated shell in order to avoid displacement and detachment of the projectiles from the shell casing and the thereby resulting imbalance during firing of the shell.

The method of fabricating such shell contemplates inserting a guide sleeve into the shell casing and between the shell casing and the guide sleeve there are embedded equal size spherical-shaped projectiles. The projectiles after being filled into the shell are exposed to pressure in the axial direction and thereafter the guide sleeve is removed. A filler mass is filled into the shell casing while the same rotates for such length of time until the projectiles are partially embedded in such filler mass and an explosive mass is filled in a liquid state into the shell casing so that the projectiles have the remaining portions thereof embedded in the explosive mass.

3 Claims, 7 Drawing Figures

SHELL AND METHOD OF MANUFACTURING THE SAME

BACKGROUND OF THE INVENTION

The present invention relates to a new and improved construction of shell of the type having a cylindrical shell casing in which there is contained an explosive mass and at the inner wall of the shell casing there bears a layer of substantially equal size, spherical-shaped projectiles which are partially embedded in the explosive mass and between which there is located a filler mass. The invention also relates to a method of manufacturing the shell of this invention.

According to a state-of-the-art shell the spherical-shaped projectiles are provided with six flattened portions at their equator zone in such a manner that a section through the equator forms a hexagon, wherein each projectile at its six neighboring projectiles bears against such flattened portion and the projectiles are adhesively bonded or glued to one another. The insertion of such projectiles into the shell casing constitutes a difficult mosaic work associated with tolerance problems which can be hardly solved. Additionally, it is hardly possible to secure these projectiles in the shell such that they do not tend to shift or displace when the shell is fired, something which must be avoided since otherwise due to friction between the projectiles and the explosive mass it is possible for the shell to prematurely detonate.

SUMMARY OF THE INVENTION

It is a primary object of the present invention to provide an improved construction of shell and method of fabricating the same which is not associated with the aforementioned drawbacks and limitations discussed above.

Another and more specific object of the invention aims at the provision of a shell in which the layer of projectiles cannot shift when firing the shell due to the acceleration forces and wherein the projectiles are uniformly distributed at the shell casing such that there cannot occur any imbalance.

Now in order to implement these and still further objects of the invention which will become more readily apparent as the description proceeds, the shell of this development is manifested by the features that the projectiles which are partially embedded in the filler mass are exposed to an axial pressure in the finished fabricated shell in order to avoid displacement and detachment of the projectiles with respect to the shell casing and thus to equally avoid the resultant imbalance during firing of the shell.

As explained above the invention is also directed to an improved method of manufacturing such shell which contemplates inserting a guide sleeve into the shell casing and between the guide sleeve and the shell jacket there is inserted a layer of equal size projectiles. A liquid filler mass which hardens upon cooling is filled between the projectiles and an explosivel mass is introduced into the interior of the shell. According to the invention the projectiles after having been filled are subjected to pressure in axial direction and then the guide sleeve is removed. The filler mass is filled, while the shell casing rotates, for such length of time until the projectiles are partially embedded in such filler mass. The explosive mass is filled in a liquid state so that the remaining portions of the projectiles are embedded in such explosive mass.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
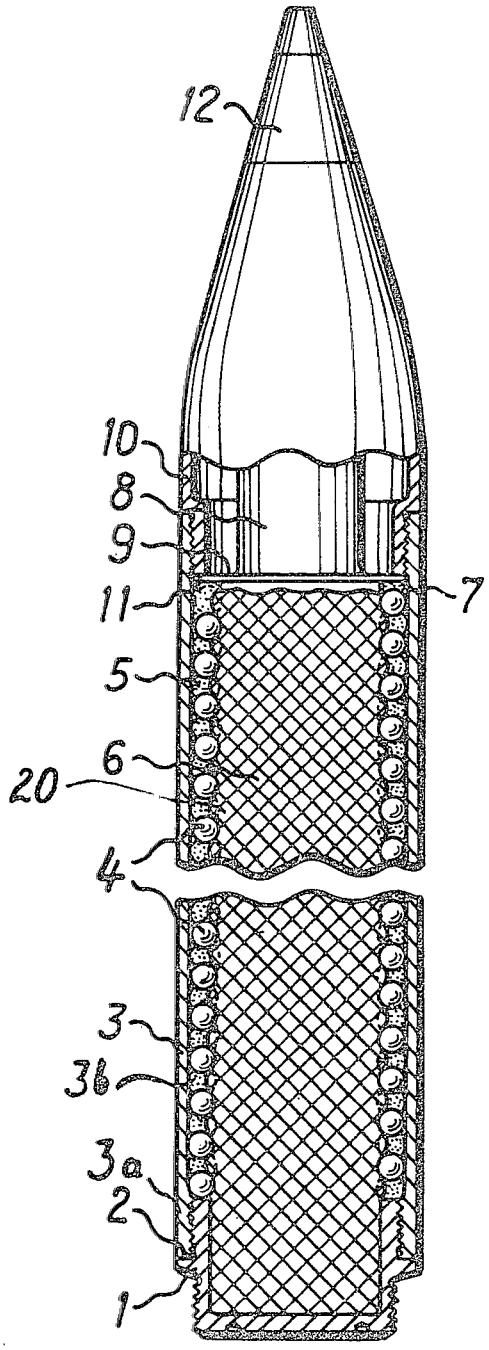
FIG. 1 is a longitudinal sectional view through a first embodiment of shell equipped with projectiles.

Describing now the drawings, according to FIG. 1 the front portion of a bushing 1 is stepped in diameter and possesses a shoulder 2. A shell casing or jacket 3 is threadably connected by threading 3a with the bushing 1 and bears against the shoulder 2. The internal diameter of the shell jacket 3 is larger than the internal diameter of the bushing 1. In the shell casing or jacket 3 there are arranged in rows next to one another ring-shaped layers of substantially spherical-shaped projectiles 4 which are of the same size. The projectiles 4 bear against the inner wall 3b of the shell casing or jacket 3. The diameter and number of projectiles 4 of a layer are the same and such that neighboring projectiles 4 are separated from one another by small intermediate spaces. The projectiles 4 of the mutually neighboring layers contact one another. The projectiles 4 are located externally of a cylinder, the diameter of which is equal to the internal diameter of the bushing 1. The hollow spaces between the individual projectiles 4 are filled with wax 5. The wax layer 5 is limited by the inner wall 3b of the shell jacket 3 and by a cylindrical surface, the radius of which is preferably equal to the spacing of the centers of the projectiles 4 from the lengthwise axis of the shell jacket 3. The hollow compartment or space 20 bounded by the projectiles 4 and the wax layer 5 contains an explosive mass or charge 6. The projectiles 4 are thus partially, preferably one-half thereof, embedded in the explosive mass 6.

Above the uppermost layer of projectiles 4 there is arranged an elastic deformable felt ring 7. A collar 9 of a sleeve 8 likewise filled with the explosive mass 6 bears upon the felt ring 7. The sleeve 8 extends into a head 10 which is threaded to the sleeve 8. The end surface 11 of the head 10 bears against the sleeve collar 9 and thereby transmits a pressure or compressive force to the felt ring 7 and thus to the jacket formed by the projectiles 4. A detonator 12 is threaded into the head 10.

Figure 6:
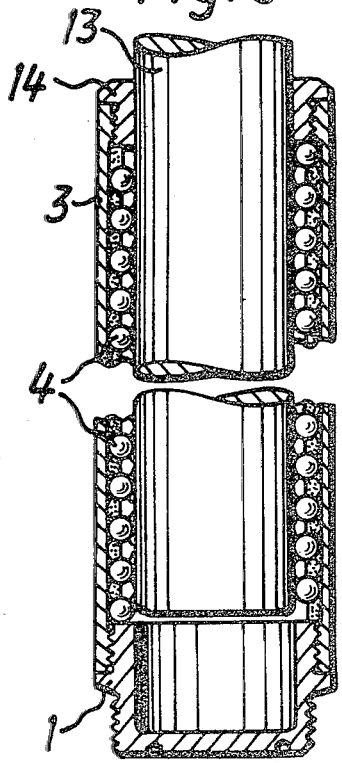
FIG. 6 is a longitudinal sectional view through the shell shown in FIGS. 1 and 2 during the fabrication thereof.

The method of producing a shell with spherical-shaped projectiles 4 resides in the features that firstly a cylindrical guide sleeve 13 is inserted into the upright positioned shell casing 3 and into the bushing 1 (FIG. 6), the outer diameter of which corresponds to the inner diameter of the jacket formed by the projectiles 4. Secondly, a ring 14 is threaded into the shell casing 3 and thus there is exerted a pressure upon the projectiles 4. Thirdly, the guide sleeve 13 is extracted out of the shell and such is placed in a horizontal position. Fourthly, the shell is rotated about its lengthwise axis, and fifthly, there is poured into the shell so much liquid wax 5 defining the filler mass that after solidification thereof such wax at least partially surrounds the projectiles 4, preferably one-half of the outer surface of such projectiles, and sixthly, after the ring 14 has been removed the explosive mass 6 is then poured into the hollow compartment or space now bounded by the wax layer 5.

By virtue of the pressure exerted by the ring 14 upon the projectiles 4 the latter bear against the inner wall of the casing 3 and the projectile jacket becomes self-supporting. The shell, after removing the guide sleeve 13, can be therefore tilted into the horizontal position without the projectiles 4 falling under the action of gravity into the interior of the shell and the projectile jacket being destroyed. The loading of the projectiles 4 of the finished shell according to FIG. 1 by means of a pressure or compressive force provides, apart from the wax 5, an additional safeguard that the projectiles 4 will also then remain in mutual contact with one another and with the shell casing 3 even if the shell during transport or when handled is subjected to jarring or shaking, or that the shell casing 3 will expand during temperature fluctuations. The requirements that the projectiles 4 should remain in contact with one another is based upon the fact that no explosive mass 6 should penetrate between the projectiles 4 since otherwise such upon being jarred are loaded by shock force and could result in premature detonation of the shell.

Figure 2:
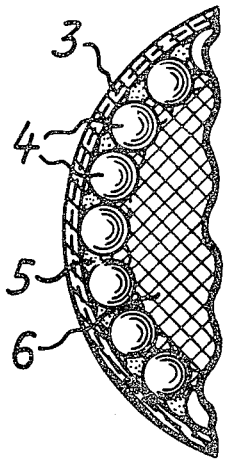
FIG. 2 is a fragmentary cross-sectional view of such shell.
Figure 3:
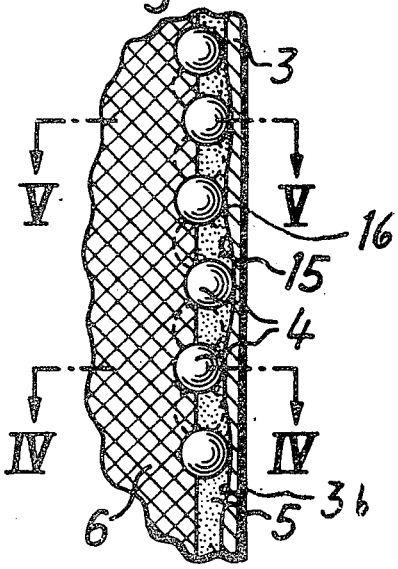
FIG. 3 is a fragmentary longitudinal sectional view through a shell according to a further exemplary embodiment.
Figure 4:
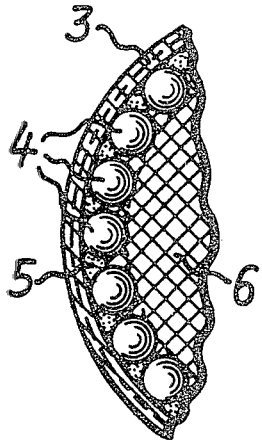
FIG. 4 is a cross-sectional view of the shell of FIG. 3 taken substantially along the line IV—IV thereof.
Figure 5:
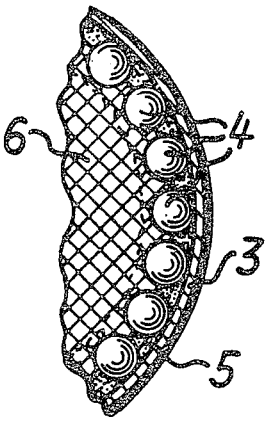
FIG. 5 is a cross-sectional view of the shell of FIG. 3, taken substantially along the line V—V thereof.

With the shell according to FIGS. 1 and 2 the projectiles 4 are propelled away in radial direction so that their scatter range has a width corresponding to the length of the projectile jacket. A shell having a wider scatter range of the projectiles 4 can be constructed according to the showing of FIGS. 3 to 5.

In the shell casing 3 there are machined or otherwise suitably formed at the inside recessed or grooved portions 15 which are delimited by the jacket of sphere zones, the centers of which are located at the shell axis. The spacing of the centers of the recessed portions 15 are preferably of the same size. Between the recessed portions 15 the inner wall of the casing is cylindrical. The fabrication of the jacket formed of projectiles 4 is identical to that for a projectile jacket according to FIGS. 1 and 2. Under the action of the pressure force exerted by the ring 14 upon the projectiles 4 such not only bear against the cylindrical portions 16 of the inner wall 3*b* of the casing 3 rather also in the recessed portions 15. The projectiles 4 extending into the recessed portions 15 are then embedded by somewhat less than one-half of their outer surface in the explosive mass 6 than those which bear at the cylindrical portions 16 of the casing inner wall.

If it is desired to increase the strength of the combination of the shell casing 3 and the jacket formed of the projectiles 4, or with the same strength of such combination in favor of for instance the explosive charge content of the shell to reduce the weight of the projectile casing 3 by reducing its wall thickness, then for instance the following techniques are possible.

Figure 7:
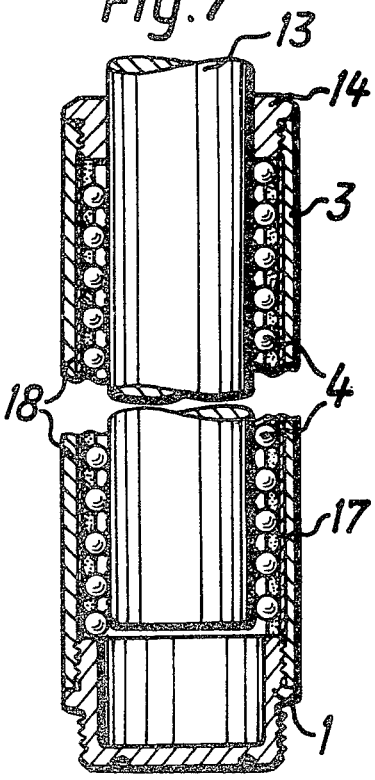
FIG. 7 is an illustration corresponding to the showing of FIG. 6 of a further exemplary embodiment.

The projectiles 4 are bonded with foils 17 (FIG. 7) which adhere to the inside of the shell casing or jacket 3. The projectiles 4 also can be mutually soldered with one another and with the casing 3. In so doing the necessary solder is applied in the form of a foil 18 to the inner wall 3*b* of the casing 3.

In both cases after the fixation of the jacket formed of the projectiles 4 by the pressure force exerted by the ring 14 there is poured into the shell, according to the previously described fabrication techniques for both of the shells according to FIGS. 1 to 5, the wax mass 5 and the explosive mass 6.

While there is shown and described present preferred embodiments of the invention, it is to be distinctly understood that the invention is not limited thereto, but may be otherwise variously embodied and practiced within the scope of the following claims. Accordingly,

What is claimed is:

1. A shell comprising a substantially cylindrical shell casing having an inner wall, an explosive mass disposed within the shell casing, substantially equal size, spherical-shaped projectiles bearing against said inner wall of the shell casing and partially embedded in the explosive mass, a filler mass disposed between the projectiles, said projectiles being partially embedded in said filler mass, the projectiles partially embedded in the filler mass being exposed to an axial pressure at the finished shell in order to prevent displacement and detachment of the projectiles from the shell casing and the thus resultant imbalance during firing of the shell.

2. The shell as defined in claim 1, wherein the diameter of the projectiles is accommodated to the periphery of the shell casing in such a manner that in the peripheral direction there prevail spaces between the individual projectiles, whereas the projectiles of neighboring rows contact one another.

3. A method of fabricating a shell having a cylindrical shell casing wherein a guide sleeve is inserted into the shell casing, equal size spherical-shaped projectiles are introduced in layer formation between the shell casing and the guide sleeve, a liquid filler mass which hardens upon cooling is filled between the projectiles and an explosive mass is introduced into the interior of the shell, the improvement comprising subjecting the projectiles after the filling thereof to pressure in axial direction, then removing the guide sleeve, filling the filler mass, with the shell casing rotating, into the shell for such length of time until the projectiles are partially embedded in such filler mass, and filling the explosive mass in a liquid state into the shell so that the remaining portions of the projectiles are embedded in the explosive mass.

* * * * *